US009266692B2

(12) United States Patent
Nakamura

(10) Patent No.: US 9,266,692 B2
(45) Date of Patent: Feb. 23, 2016

(54) CONVEYING APPARATUS AND RECORDING APPARATUS WITH MOVABLE DRIVE ROLLER AND MOVABLE PINCH ROLLER

(75) Inventor: Takao Nakamura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/561,563

(22) Filed: Jul. 30, 2012

(65) Prior Publication Data

US 2013/0043640 A1 Feb. 21, 2013

(30) Foreign Application Priority Data

Aug. 19, 2011 (JP) ..... 2011-179476

(51) Int. Cl.
*B65H 5/00* (2006.01)
*B65H 9/00* (2006.01)

(52) U.S. Cl.
CPC ..... *B65H 9/006* (2013.01); *B65H 2403/42* (2013.01); *B65H 2403/72* (2013.01); *B65H 2404/14* (2013.01); *B65H 2404/1442* (2013.01); *B65H 2801/06* (2013.01)

(58) Field of Classification Search
USPC ..... 271/10.13, 114, 116, 242, 270, 271/272–274
See application file for complete search history.

(56) References Cited

U.S. PATENT DOCUMENTS

| | | | | |
|---|---|---|---|---|
| 6,693,728 | B1 | 2/2004 | Kinoshita et al. | |
| 6,793,216 | B2 | 9/2004 | Nakamura | |
| 6,945,528 | B2 | 9/2005 | Nakamura | |
| 6,955,349 | B2 | 10/2005 | Watase | |
| 7,533,878 | B2 * | 5/2009 | Cook et al. | 271/114 |
| 7,810,808 | B2 | 10/2010 | Hamahashi | |
| 8,925,918 | B2 * | 1/2015 | Kiuchi | 271/186 |
| 8,973,920 | B2 * | 3/2015 | Hakamata | 271/264 |
| 2011/0133399 | A1 * | 6/2011 | Katayama | 271/272 |

FOREIGN PATENT DOCUMENTS

| | | | |
|---|---|---|---|
| JP | 2003-292200 | A | 10/2003 |
| JP | 2004-026353 | A | 1/2004 |
| JP | 2004-123377 | A | 4/2004 |
| JP | 2008-051890 | A | 3/2008 |
| JP | 2008-068999 | A | 3/2008 |

* cited by examiner

*Primary Examiner* — Gerald McClain
(74) *Attorney, Agent, or Firm* — Fitzpatrick, Cella, Harper & Scinto

(57) ABSTRACT

A conveying apparatus has a sheet conveying path, a first pair of rollers, which is positioned in the conveying path and which has a drive roller and a pinch roller and conveys the sheet, a second pair of rollers, which is positioned downstream relative to the first pair of rollers in the conveying direction and conveys the sheet conveyed by the first pair of rollers, and a mechanism which reduces the force for sandwiching the sheet by the drive roller and the pinch roller of the first pair of rollers or which moves both away from each other. After the sheet is conveyed by the first pair of rollers while the leading edge of the sheet is being stopped by the second pair of rollers, the second pair of rollers starts conveying the sheet, and the mechanism is actuated thereafter.

18 Claims, 18 Drawing Sheets

CONVEYING APPARATUS AND RECORDING APPARATUS WITH MOVABLE DRIVE ROLLER AND MOVABLE PINCH ROLLER

BACKGROUND OF THE INVENTION

1. Field of the Invention

The present invention relates to a conveying apparatus which conveys a sheet in a recording apparatus.

2. Description of the Related Art

With the increasing widespread use of ink jet recording apparatuses in recent years, there has been demand for higher image recording quality and reduced sizes and lower costs of recording apparatuses.

To achieve the reduced size and lower cost of a recording apparatus, it is desirable to carry out only U-turn feed rather than two types of feed, namely, straight conveyance and the U-turn conveyance.

The U-turn conveyance requires a U-shaped conveyance path (hereinafter referred to as "the U-turn path") for reversing a sheet between a feed roller and an LF roller, i.e., reversing the front and the back of the sheet. However, the diameter of the U-turn path is required to be increased to a certain degree in order to reverse a highly rigid sheet used for high image quality without causing the sheet to buckle or warp.

An increased diameter of the U-turn path causes a sheet to be conveyed along a guide substantially on the outer side of the U-turn path, resulting in a longer distance for conveying the sheet in the U-turn path. However, conveying a small-sized sheet, such as, an L-size sheet having a length of 127 mm, requires that the distance between the feed roller and the LF roller be set to a value smaller than 127 mm. Actually, it is difficult to set the distance between the feed roller and the LF roller to be smaller than 127 mm. For this reason, an intermediate roller is usually provided between the two rollers in the case where the diameter of the U-turn path is increased.

In a recording apparatus provided with the feed roller, the LF roller and the intermediate roller, there are cases where a sheet is conveyed in a skewed manner when fed from the feed roller to the LF roller through the intermediary of the intermediate roller. Generally, therefore, the skew is corrected by abutting the leading edge of the sheet conveyed from the intermediate roller against a pair of rollers having the LF roller so as to properly straighten the leading edge, with the LF roller being at rest or rotated in the reverse direction (rotated in the opposite direction from the direction for conveying the sheet).

However, the pair of rollers constituted of the intermediate roller and a driven roller, which is paired with the intermediate roller, continues to sandwich the sheet therebetween, so that the skew of the sheet at the position of the intermediate roller is be corrected. This causes a distortion in the sheet held by the pair of rollers having the LF roller and the pair of rollers having the intermediate roller. The distortion in the sheet in turns leads to a difference in the conveying forces applied to both edges in the width direction of the sheet in the conveyance thereafter, thus conveying the sheet in a skewed manner.

As a solution to the problem described above, there are methods for preventing the distortion of a sheet by temporarily moving an intermediate roller away from the sheet, as disclosed in, for example, U.S. Pat. No. 7,533,878.

To correct the skew of the leading edge of the sheet, the sheet is conveyed by the intermediate roller to abut the leading edge of the sheet against the LF roller while holding the LF roller at rest or rotating the LF roller in the reverse direction. To correct the skew of the leading edge of the sheet, it is necessary to continue to convey the sheet by the intermediate roller until both ends in the width direction of the sheet abut against the pair of rollers having the LF roller.

The sheet continues to be conveyed by the intermediate roller whereas the leading edge of the sheet abutted against the pair of rollers having the LF roller cannot move. If, therefore, the sheet has low rigidity, then the sheet curves in the U-turn path between the LF roller and the intermediate roller. In the case of a highly rigid sheet, however, the sheet cannot curve in the U-turn path between the LF roller and the intermediate roller, thus generating a high conveyance resistance against the intermediate roller.

In the case of the construction disclosed in U.S. Pat. No. 7,533,878, the intermediate roller is supported by a swing arm so as to allow the intermediate roller to be moved away from the sheet. However, when the intermediate roller supported by the swing arm adds to the conveyance resistance, a force moment acts to increase the force of the intermediate roller, which force pushes a driven roller paired with the intermediate roller (hereinafter referred to as "the engaging force"). An increased engaging force causes the pair of rollers, namely, the intermediate roller and the driven roller, to firmly sandwich the sheet, making it difficult to convey the sheet by the intermediate roller. Further, if the state in which the sheet is firmly sandwiched by the pair having the intermediate roller continues, then it becomes difficult to correct the distortion of the sheet between the intermediate roller and the LF roller. As a result, there are cases where the skew of the leading edges of the sheet is not successfully corrected.

SUMMARY OF THE INVENTION

Accordingly, the present invention has been made with a view toward the problem described above, and it is an object of the invention to provide a conveying apparatus capable of successfully correcting the skew of a sheet.

A conveying apparatus in accordance with the present invention includes: a first pair of rollers, which is positioned in a conveyance path along which a sheet is conveyed, has a drive roller and a driven roller, and conveys the sheet in a predetermined conveying direction; a second pair of rollers, which is positioned on a downstream relative to the first pair of rollers in the conveying direction and conveys the sheet conveyed by the first pair of rollers; and a mechanism which reduces the force for sandwiching the sheet by the drive roller and the driven roller of the first pair of rollers or which moves both away from each other, wherein after the sheet is conveyed by the first pair of rollers while the leading edge of the sheet is being stopped by the second pair of rollers, the second pair of rollers starts conveying the sheet, and the mechanism is actuated thereafter.

According to the present invention, the skew of a sheet can be successfully corrected.

Further features of the present invention will become apparent from the following description of exemplary embodiments with reference to the attached drawings.

DESCRIPTION OF THE EMBODIMENTS

Figure 1:
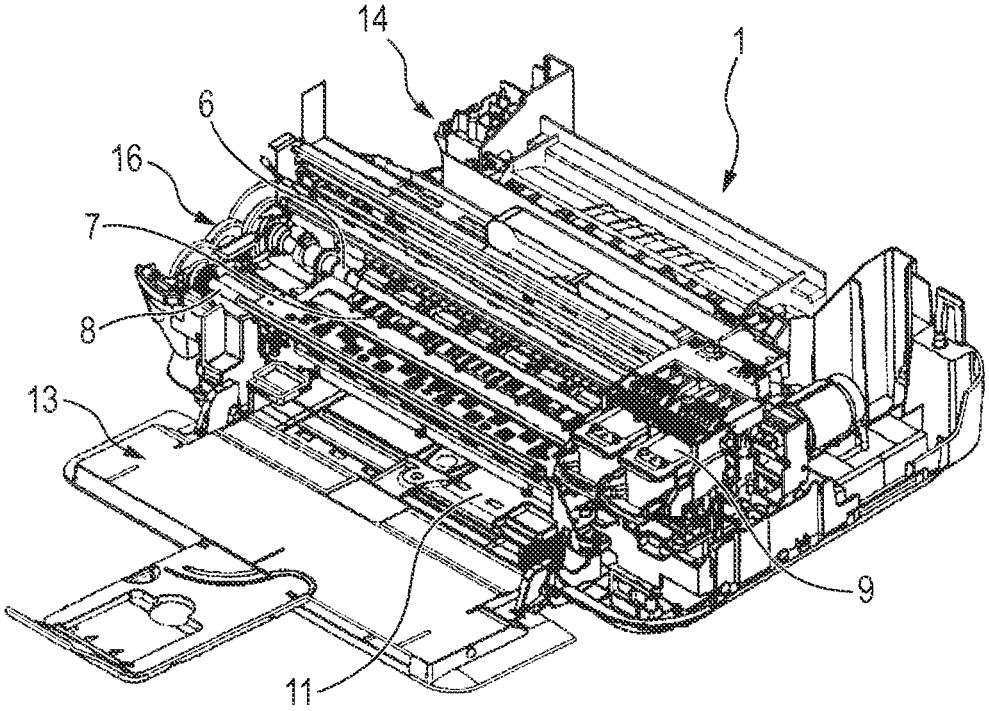
FIG. 1 is a perspective view of a first embodiment of a conveying apparatus in accordance with the present invention and a recording apparatus having the conveying apparatus.

The following will describe embodiments of the present invention in detail with reference to the accompanying drawings. The same functions will be assigned the same reference numerals in the accompanying drawings and the descriptions thereof will be omitted in some cases.

First Embodiment

Figure 2:
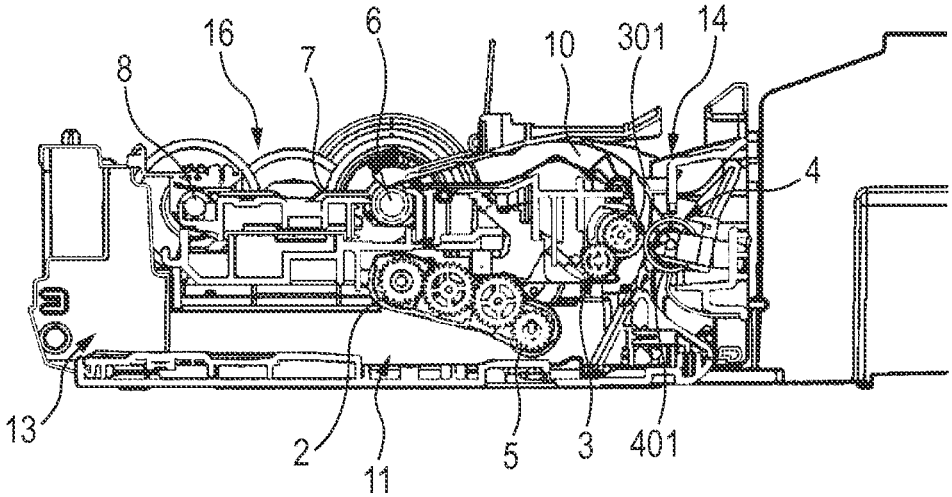
FIG. 2 is a sectional view of the recording apparatus in FIG. 1.

FIG. 1 is a perspective view of a first embodiment of the conveying apparatus in accordance with the present invention and a recording apparatus that has the conveying apparatus. FIG. 2 is a sectional view of the recording apparatus in FIG. 1. In FIG. 2, a sheet discharging portion 13 in FIG. 1 is in a folded state.

A conveying apparatus provided in a recording apparatus 1 in accordance with the present invention has a stacking portion 11 on which sheets P, which are sheet-type recording media (refer to FIG. 9), are placed. On the downstream side of the stacking portion 11 relative to the direction in which the sheets P are conveyed, a reversal conveying portion 14, a horizontal conveying portion 16, and the sheet discharging portion 13 are provided in this order.

Provided between the stacking portion 11, on which the sheets P are placed, and the reversal conveying portion 14, are a pickup roller 2, which comes in contact with an uppermost sheet P stacked on the stacking portion 11 to pick the sheet P up, and a sheet feeding roller 5, which conveys the picked-up sheet P to the reversal conveying portion 14.

The reversal conveying portion 14 is provided with a conveying path 10 shaped substantially shaped like U (hereinafter referred to as "the U-turn path"). The sheet P conveyed to the reversal conveying portion 14 is passed through the U-turn path 10 so that the direction of conveyance thereof is reversed, that is, the front and the back thereof are reversed, and then conveyed to the horizontal conveying portion 16. The reversal conveying portion 14 is provided with a pair of rollers (a first pair of rollers) of a drive roller 301, which is an intermediate roller provided on a drive roller arm unit 3, and a driven roller (pinch roller) 401 provided on a driven roller arm unit 4.

In the recording apparatus 1, a recording portion, which performs recording on the sheet P, is provided at the position of the horizontal conveying portion 16. The recording portion has a platen 7, which supports the sheet P, and a recording head unit 9, which opposes the platen 7 and which is capable of scanning positions spaced away from each other. The sheet P is conveyed by a pair or rollers (a second pair of rollers) constituted of an LF roller 6 (line feed roller), which is a conveying roller, and a pinch roller 61, which rollers are provided on the horizontal conveying portion 16 (refer to FIG. 3). During the conveyance, an image is formed on the sheet P by the recording head unit 9 and then the sheet P is discharged to the sheet discharging portion 13 by a sheet discharging roller 8.

In the conveying apparatus according to the present invention, the stacking portion 11 and the sheet discharging portion 13 are provided in the same direction, and the conveying direction of the sheet P is reversed between the stacking portion 11 and the sheet discharging portion 13, which is so-called U-turn conveyance.

Figure 16:
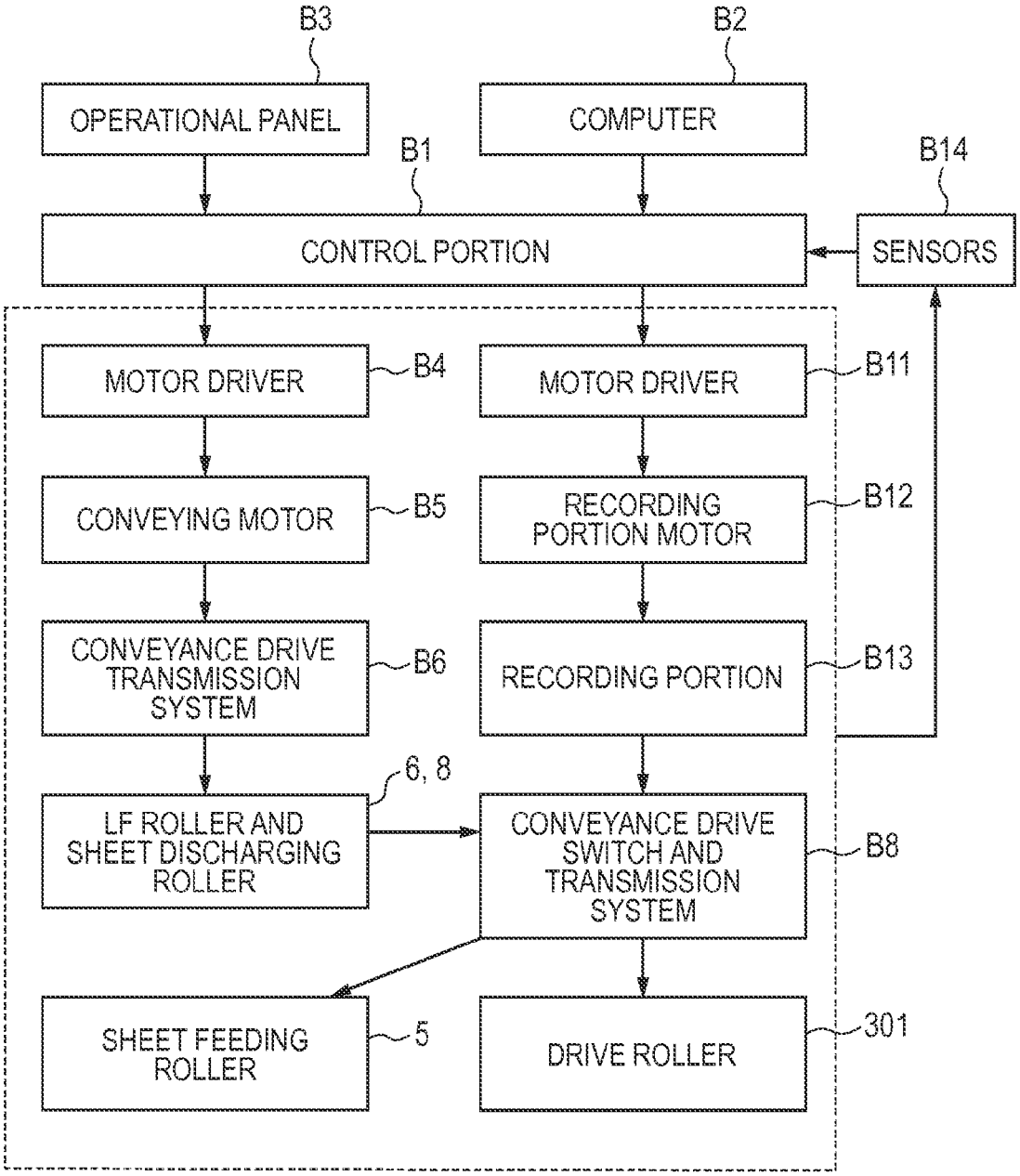
FIG. 16 is a schematic control block diagram of a recording apparatus.

FIG. 16 is a schematic control block diagram of the recording apparatus. A control portion B1 receives recording instructions from a computer B2 or an operation panel B3, which are connected through the intermediary of an interface of the control portion B1, or starts a recording operation by a timer or the like in the control portion B1. Then, the control portion B1 issues an instruction to supply power to a conveying motor B5 connected to a conveyance drive transmission system B6 through the intermediary of a conveying motor driver B4. Further, the LF roller 6 and the sheet discharging roller 8 to which a driving force has been transmitted from the conveying motor B5 through the intermediary of the conveyance drive transmission system B6 convey the sheet P at the time of recording and also transmit the driving force to a conveyance drive switch and transmission system B8.

Concurrently, the control portion B1 issues an instruction to supply power to the recording portion motor B12, which is connected to the recording portion B13, through the intermediary of a recording portion motor driver B11. The recording portion B13 is connected such that the drive switching of the conveyance drive switch and transmission system B8 can be accomplished.

The conveyance drive switch and transmission system B8 switches between transmission and cutoff of the driving force transmitted from the LF roller 6 and the sheet discharging roller 8 and also switches the direction of rotation according to the operation of the recording portion B13, and then transmits the driving force to the sheet feeding roller 5 and the drive roller 301.

The rotation state and the load state of each motor and the conveyance state of the sheet P are detected by sensors B14 provided in places of the conveying apparatus, and the information is sent in the form of signals to the control portion B1.

The control portion B1 controls each motor on the basis of instructions and the information on the sensors to carry out recording.

Figure 3:
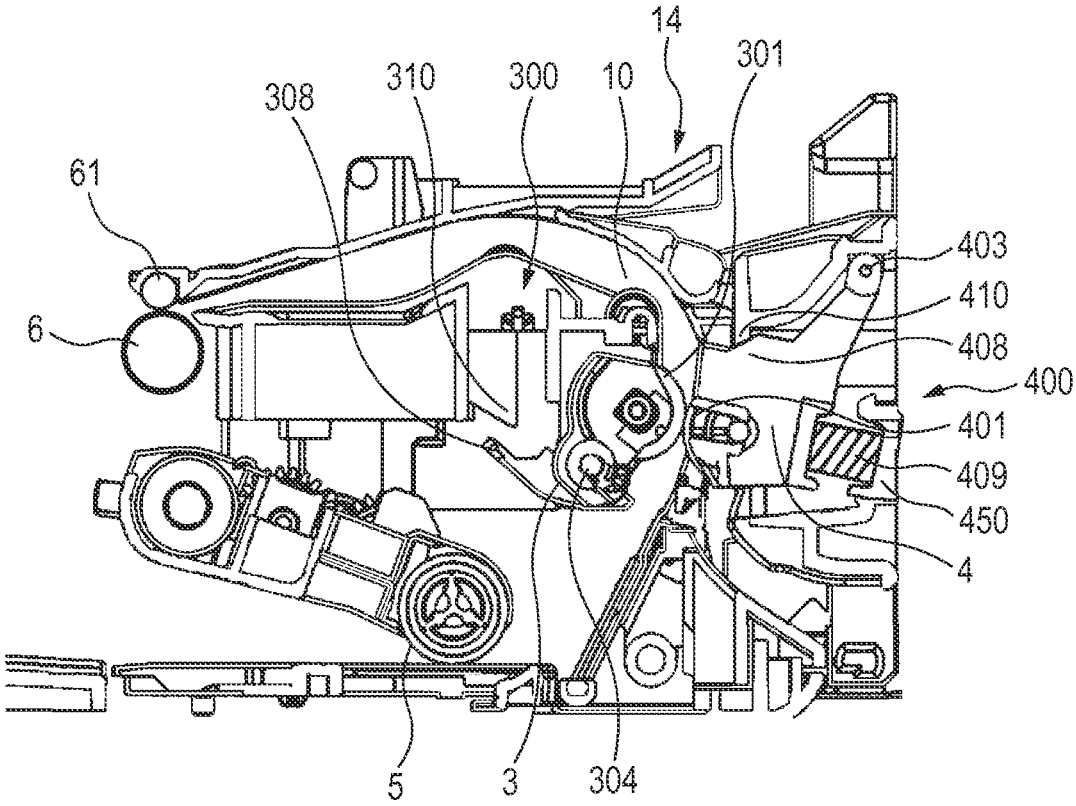
FIG. 3 is a schematic diagram of a reversal conveying portion, illustrating the position of a first position.

A description will now be given of the reversal conveying portion 14, which characterizes the conveying apparatus in accordance with the present invention, and the position and the second position. FIG. 3 is a schematic diagram of the reversal conveying portion 14 for describing the first position. The position of each of an inner guide unit 300 and a rear guide unit 400 when the conveying apparatus is in a non-operating state or immediately before the leading edge of the sheet P reaches the LF roller 6 while the conveying apparatus is operating is defined as the first position.

The reversal conveying portion 14 is constituted mainly of the inner guide unit 300, which forms the inner boundary of the curve of the U-turn path 10, and the rear guide unit 400, which forms the outer boundary. The inner guide unit 300 has a drive roller arm unit 3 that includes a conveying rib (not shown), which forms the inner boundary of the U-turn path 10, a drive arm rotating shaft 304, the drive roller 301, a drive arm stopper 308 and a drive arm 302 (refer to FIG. 5). The inner guide unit 300 further includes an inner guide abutting portion 310, which receives the drive arm stopper 308.

Figure 7:
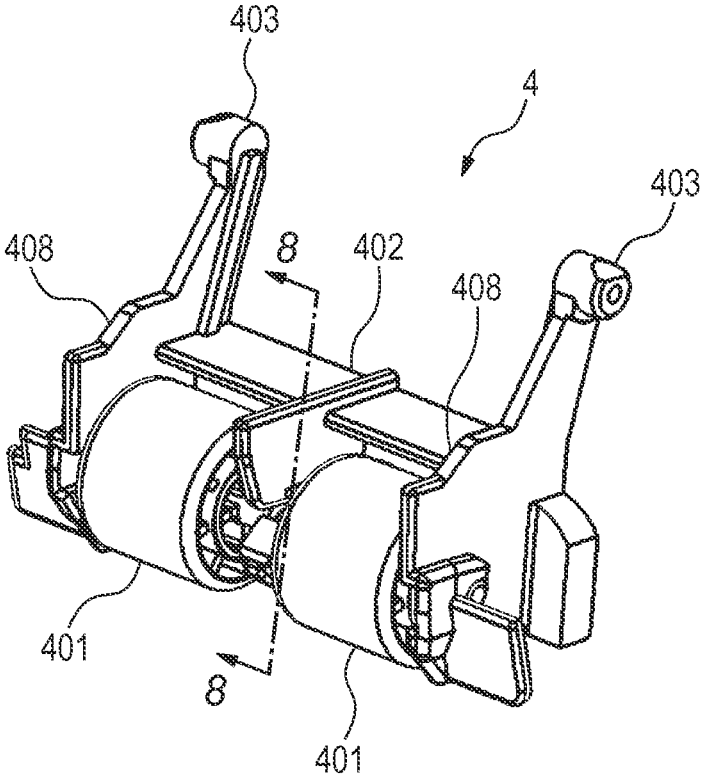
FIG. 7 is a schematic perspective view illustrating the construction of a driven roller arm unit.

The rear guide unit 400 has the driven roller arm unit 4, which includes a conveying rib (not shown) constituting the outer boundary of the U-turn path 10, a driven arm rotating shaft 403, a driven arm stopper 408, a driven roller 401, and a driven arm 402 (refer to FIG. 7). The rear guide unit 400 further has a rear guide stopper 410, which receives the driven arm stopper 408, a spring 409, and a spring receiver 450.

As described above, the drive roller 301 and the driven roller 401 constitute the pair of rollers (the first pair of rollers).

Figure 5:
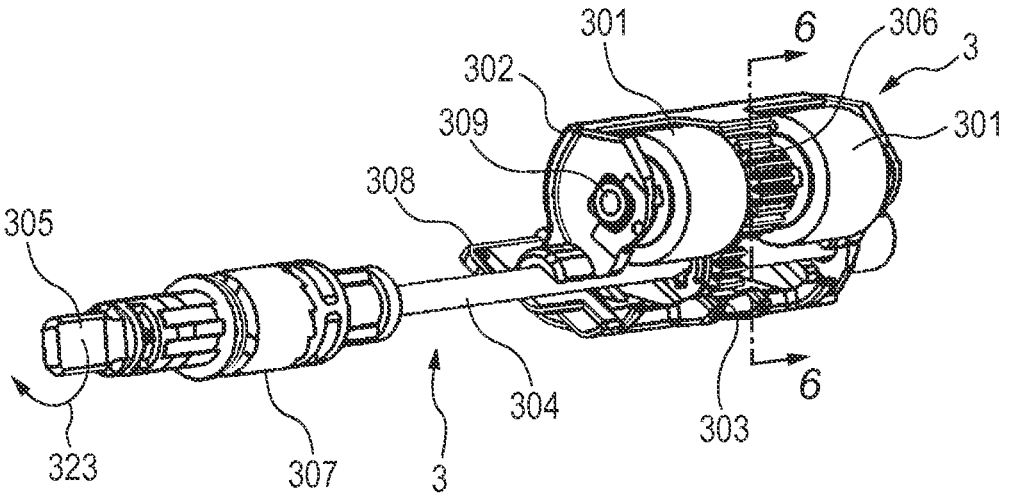
FIG. 5 is a schematic perspective view illustrating the construction of a drive roller arm unit.
Figure 6:
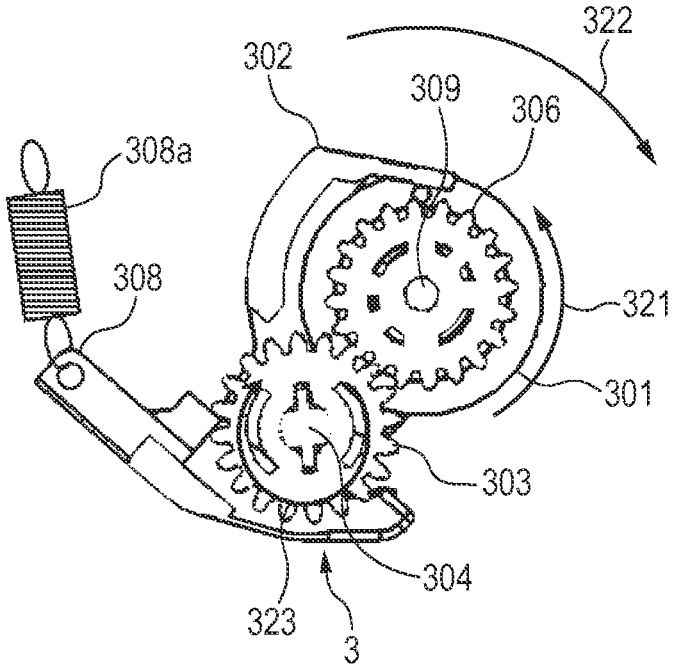
FIG. 6 is a schematic diagram of section 6-6 in FIG. 5.

FIG. 5 is a schematic perspective view illustrating the configuration of the drive roller arm unit 3, and FIG. 6 is a schematic diagram of section 6-6 in FIG. 5. A driving force from an unshown drive source (the conveying motor B5) in the direction of an arrow 323 is transmitted to a transmission shaft 305, which is a rotating member on the driving side. The rotational force transmitted to the transmission shaft 305 is further transmitted to the drive arm rotating shaft 304 through the intermediary of a drive arm clutch mechanism 307 having a one-way clutch. The transmission shaft 305 can be swung coaxially with the drive arm rotating shaft 304. The driving force transmitted to the drive arm rotating shaft 304 is further transmitted to a drive gear 303 provided on the drive arm rotating shaft 304 and a roller gear 306, which is rotatively supported by the drive arm 302 through a rotating shaft 309 and which engages a drive gear 303. The driving force is transmitted to a drive roller 301 through the intermediary of a gear train having the drive gear 303 and the roller gear 306. Further, the drive arm 302 is urged by a spring 308*a* in the direction of an arrow 322, i.e., toward the driven roller 401.

Figure 8:
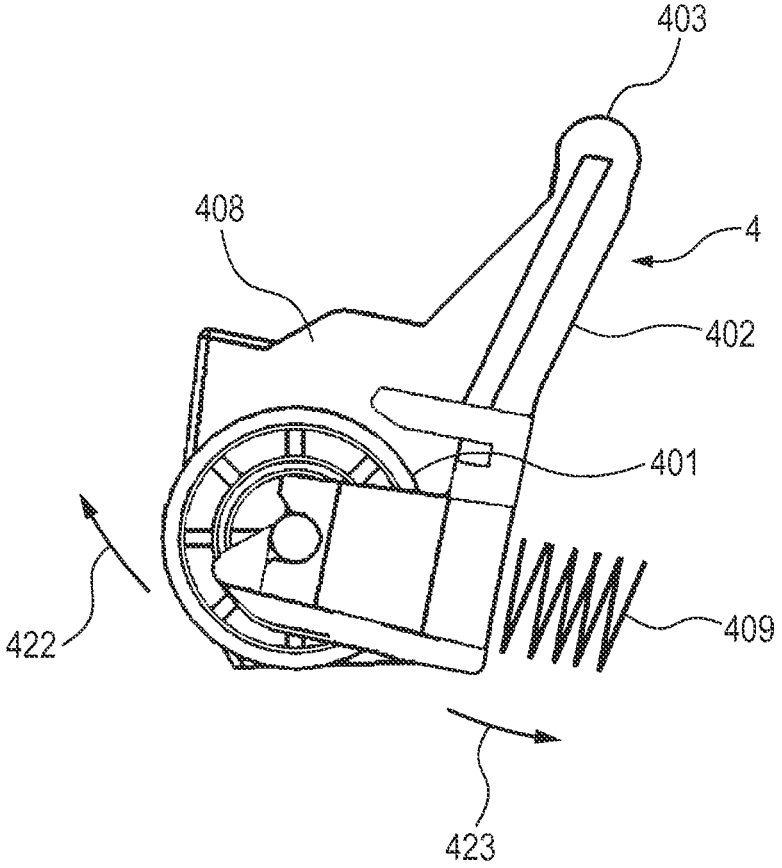
FIG. 8 is a schematic diagram of section 8-8 in FIG. 7.

FIG. 7 is a schematic perspective diagram illustrating the configuration of the driven roller arm unit 4, and FIG. 8 is a schematic diagram of section 8-8 in FIG. 7. The driven roller arm unit 4 can be rotated about the driven arm rotating shaft 403. The driven roller arm unit 4 is urged by the spring 409, which is provided between a spring receiver 450 and the driven roller arm 402 in a rear guide unit 400, in the direction of an arrow 422, i.e., toward the drive roller 301.

As described above, the drive arm 302 is urged by the weak spring 308*a* toward the driven roller 401. However, the pressing force of the spring 308*a* is sufficiently small relative to the pressing force of the spring 409, so that the driven arm stopper 408 is abutted against the rear guide stopper 410 while the conveying apparatus is not in operation (refer to FIG. 3).

The driven roller 401 rotatively supported by the driven roller arm 402 does not rotate by itself, but when the drive roller 301 is pressed thereagainst, the driven roller 401 rotates by coming in direct contact therewith or through the intermediary of the sheet P.

Figure 4:
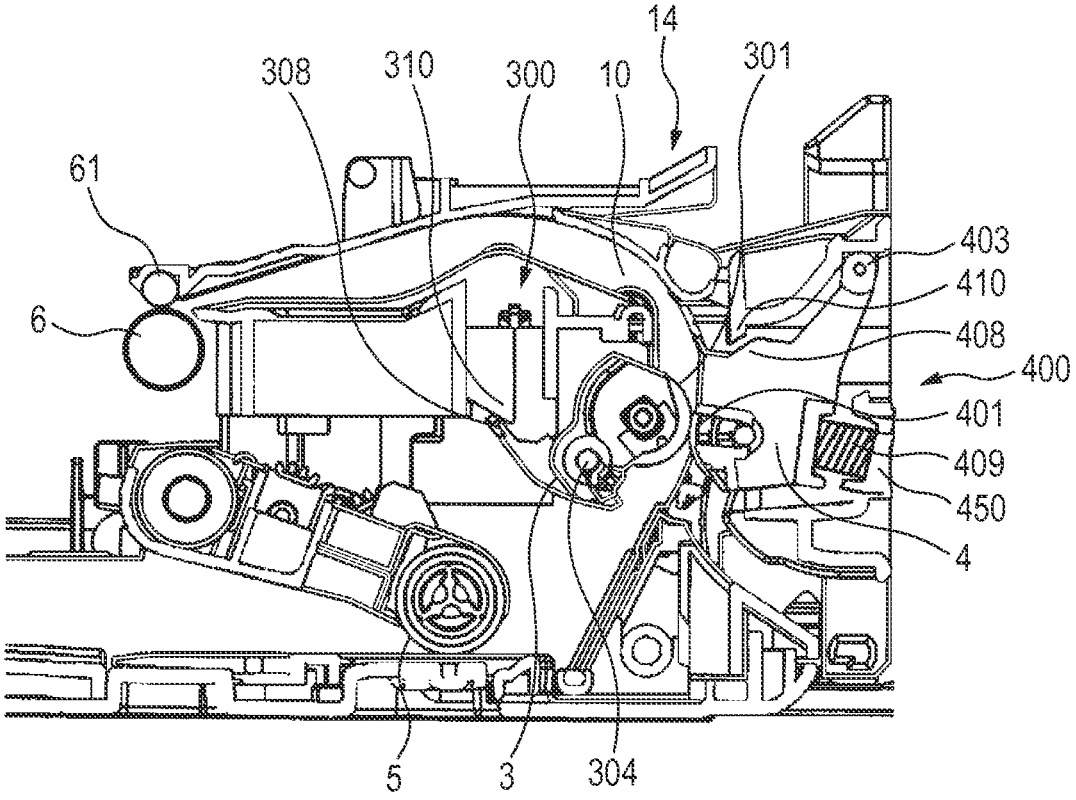
FIG. 4 is a schematic diagram of a reversal conveying portion, illustrating the position of a second position.

FIG. 4 is a schematic diagram of the reversal conveying portion 14 for describing the second position. The position of each member of the inner guide unit 300 and the rear guide unit 400 in a state, wherein the leading edge of the sheet has reached the LF roller 6 at rest or rotating in the reverse direction (rotating in the opposite direction from the direction in which the sheet is conveyed), is defined as the second position.

The process of the transition from the first position to the second position will now be described (more details will be given later). When the first pair of rollers conveys the sheet P, the leading edge of the sheet P comes in contact with the second pair of rollers, which has the LF roller 6. Since the LF roller 6 is at rest or rotating in the reverse direction, the leading edge of the sheet P cannot be advanced any further. Hence, the drive roller 301 is subjected to conveyance resistance (a force interfering with the conveyance of the sheet P) from the leading edge of the sheet P through the sheet P. The conveyance resistance adds to the rotational resistances of the drive roller 301 and the roller gear 306, which rotates integrally with the drive roller 301. If the rotational resistance of the roller gear 306 is low to a certain degree as in the case of conveying a sheet in a normal mode, then the rotational force of the drive gear 303 acts to rotate the roller gear 306. If the rotational resistance of the roller gear 306 is high, then the rotational force of the drive gear 303 changes into a force that causes the roller gear 306 to revolve around the drive gear 303, i.e., a force that causes the drive arm 302 to rotate in the direction of the arrow 322. If the drive roller 301 is continued to be driven under the high conveyance resistance, then the driving force in the direction of the arrow 323, which has been transmitted to the drive gear 303, causes a moment in the direction of the arrow 322 about the rotating shaft 304 to act on the drive arm 302 (refer to FIG. 6). Then, the moment leads to the generation of a force that presses the drive roller 301 against the driven roller 401 (hereinafter referred to as "the pressing force").

If the pressing force exceeds the urging force of the spring 409, the whole drive arm unit 3 begins to circularly move in the direction of the arrow 322 about the rotating shaft 304. The drive roller 301 attempts to feed the sheet P, but the LF roller 6 is at rest or rotating in the reverse direction, so that the leading edge of the sheet P remains stopped at the position of the second pair of rollers. Thus, the moment in the direction of the arrow 322 causes the drive arm 302 to circularly move in the direction of the arrow 322, and the pressing force of the drive roller 301 moves the driven roller 401 against the urging force of the spring 409. The drive arm 302 circularly moves until the drive arm stopper 308 abuts against the abutting portion 310 in the inner guide unit 300. The position of each member of the inner guide unit 300 and the rear guide unit 400 in such a state is defined as the second position. At this time, the pressing force does not increase any further, because the rotation of the drive arm unit 3 stops.

Figure 15:
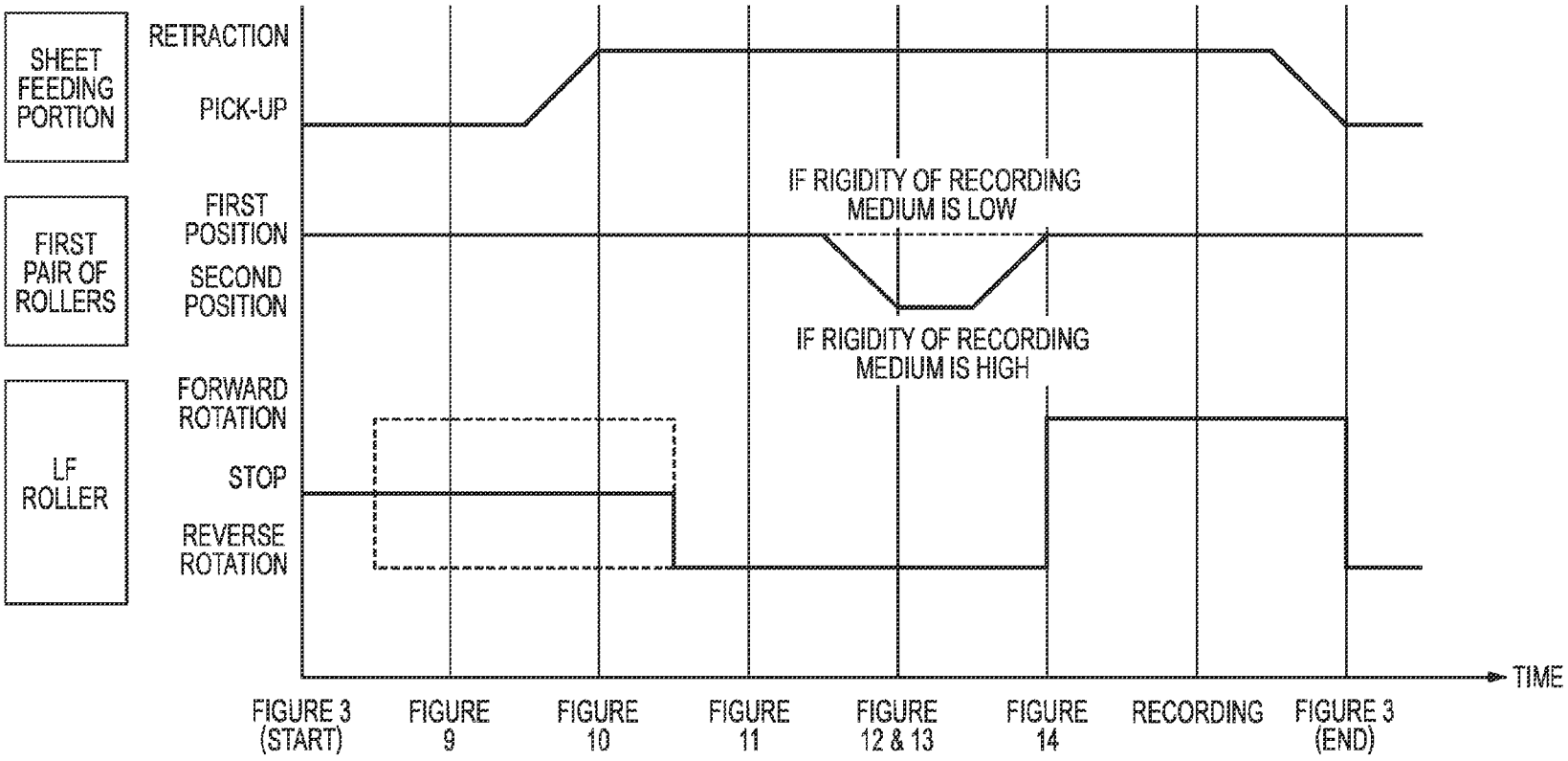
FIG. 15 is a timing chart of a feed roller, an LF roller and the first pair of rollers.
Figure 17:
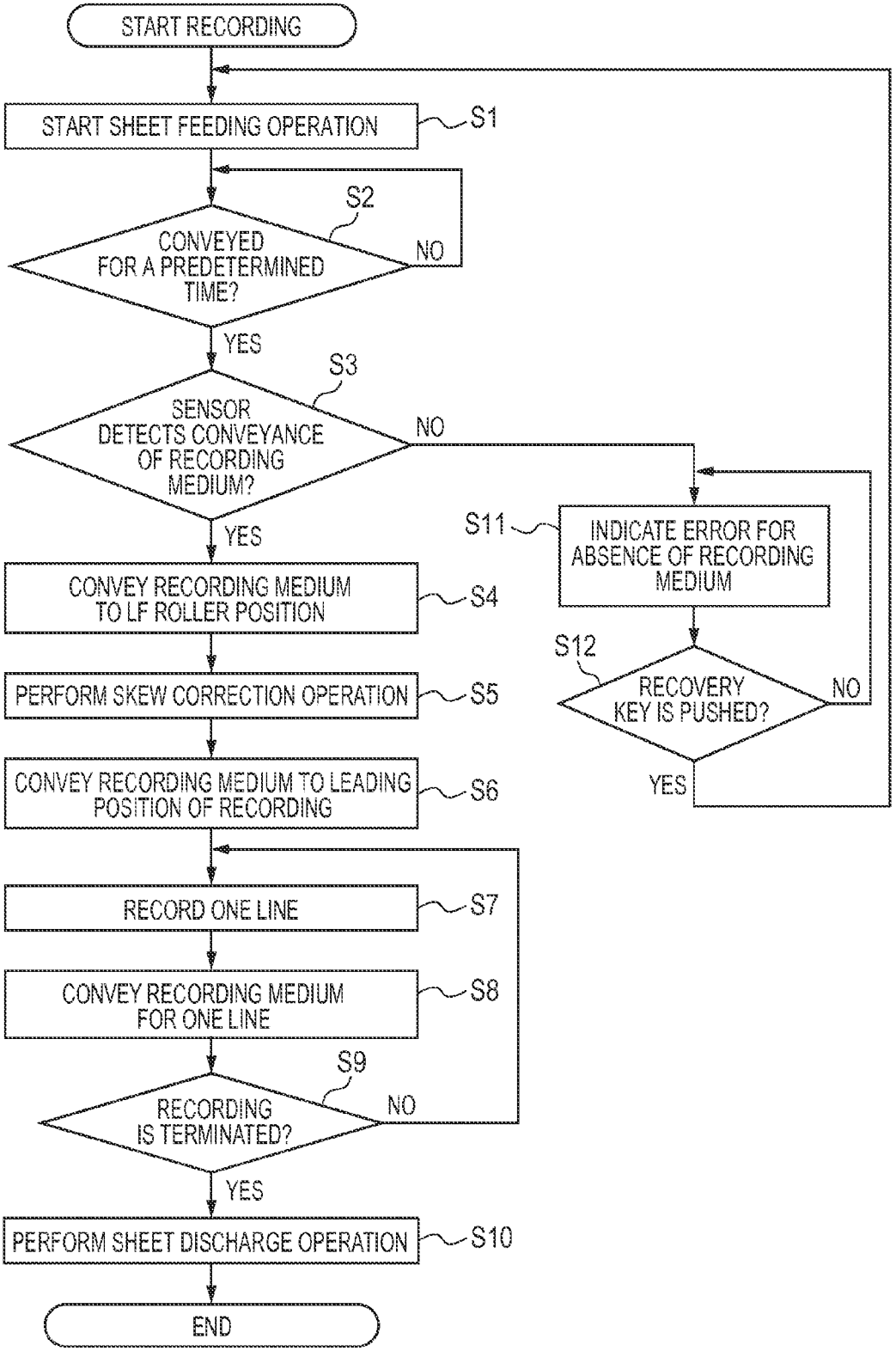
FIG. 17 is a schematic flowchart of a recording operation of the recording apparatus.

The conveying operation of the sheet P carried out by the conveying apparatus in accordance with the present invention will now be described by referring to the schematic flowchart of the recording operation of the recording apparatus in FIG. 17. FIGS. 9 to 14 are schematic diagrams illustrating the series of operations of the conveying apparatus from sheet feeding up to the instant immediately before recording begins, and FIG. 15 is a timing chart of the sheet feeding roller, the LF roller, and the first pair of rollers.

When a recording instruction is sent from the computer B2 or the like to the control portion B1 of the recording apparatus 1, the control portion B1 sends a command to the motor driver B4 so as to drive the conveying motor B5, which is the drive source for the conveyance. Then, the rotational force is transmitted to each of the sheet feeding roller 5, the drive roller 301, the LF roller 6, and the sheet discharging roller 8, thereby starting the sheet feeding operation (S1) (refer to FIG. 3).

As described above, the one sheet P separated from the stack of sheets set on the stacking portion 11 is conveyed toward the reversal conveying portion 14 by the sheet feeding roller 5. At this time, the LF roller 6 is not holding the sheet P, so that the LF roller 6 may be at rest, rotating in the forward direction (the direction of rotation for conveying the sheet P) or rotating in the reverse direction. If, however, a sheet that has already been conveyed before the sheet P to be conveyed by the sheet feeding roller 5 and has had recording performed thereon has not yet been discharged, then the LF roller 6 is rotated in the forward direction.

Figure 9:
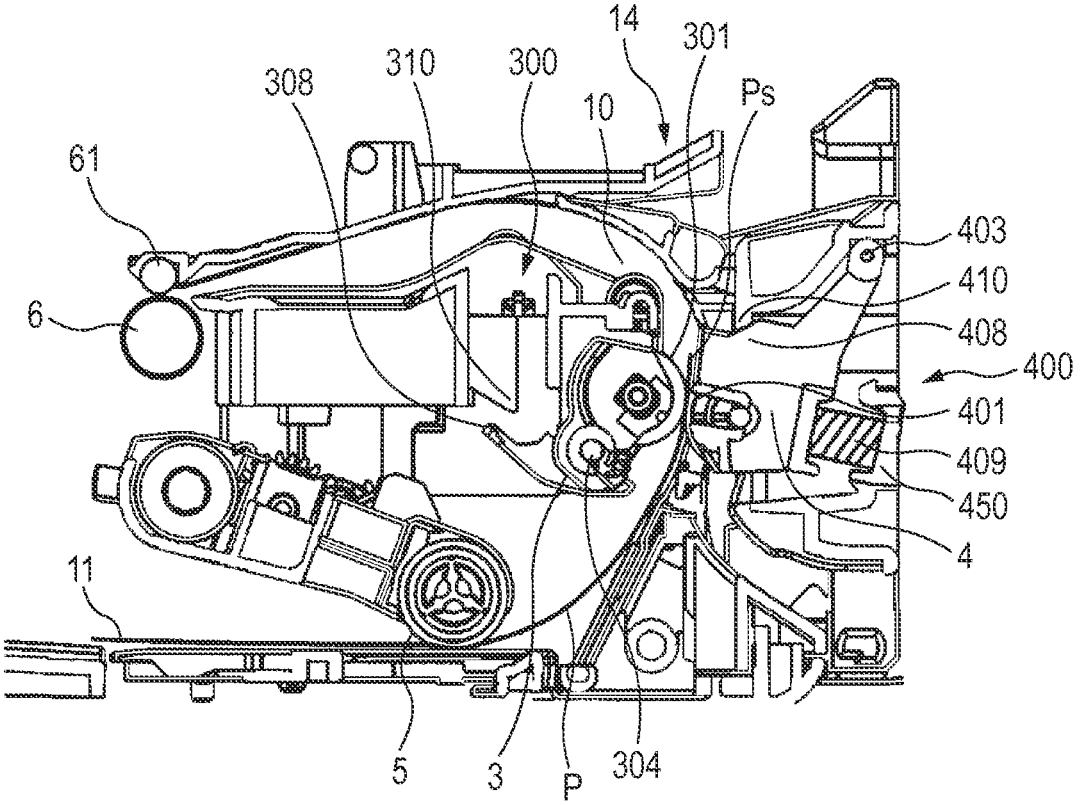
FIG. 9 is a schematic diagram illustrating the state of the reversal conveying portion when a sheet is fed.
Figure 10:
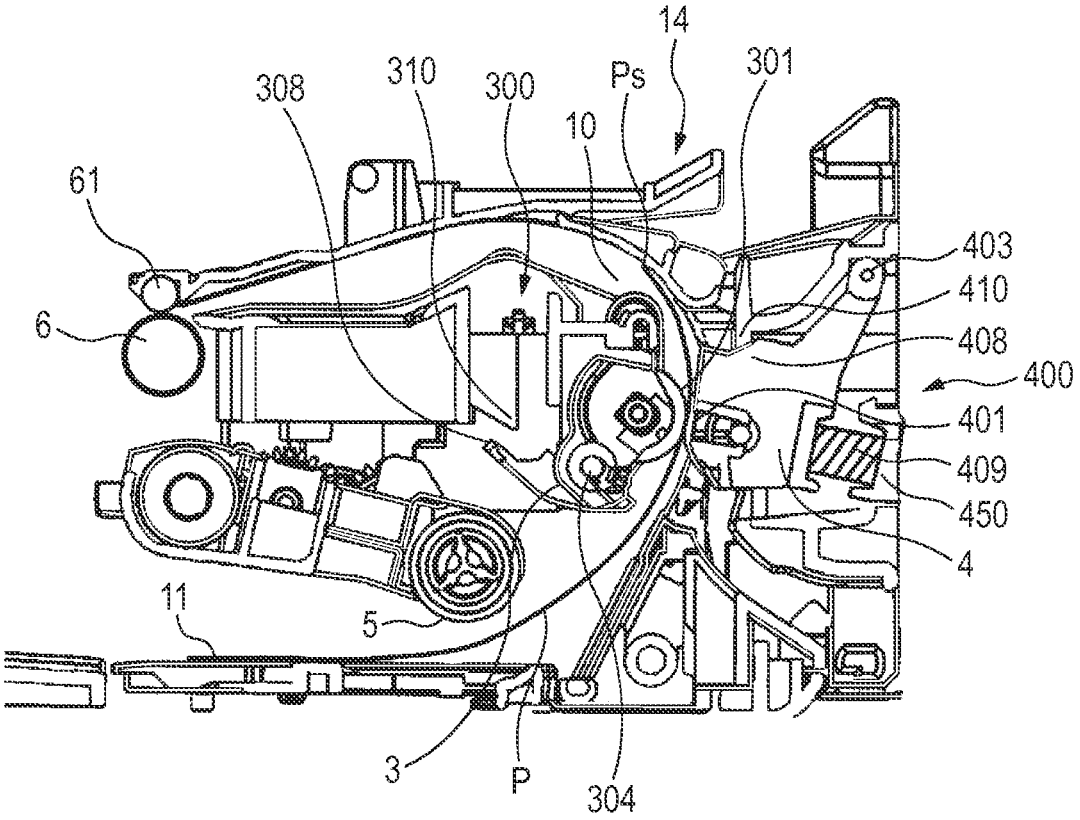
FIG. 10 is a schematic diagram illustrating the state of the reversal conveying portion when a first pair of rollers feeds the sheet.
Figure 11:
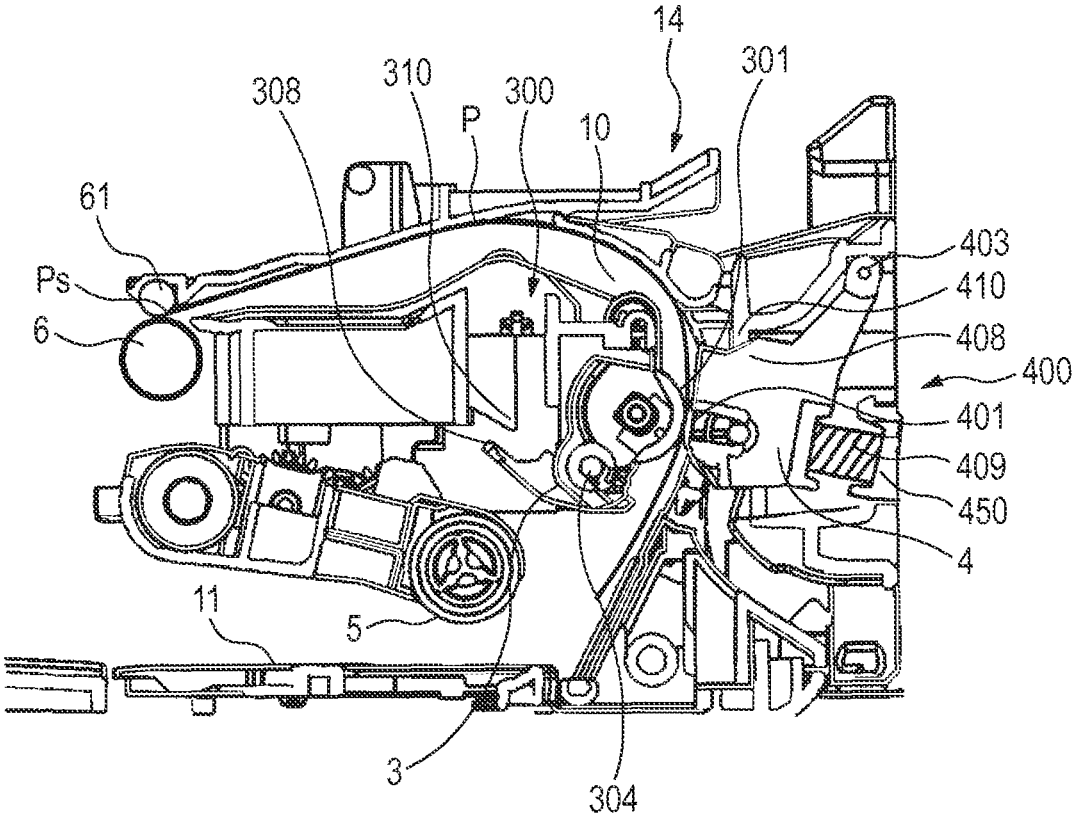
FIG. 11 is a schematic diagram illustrating the state of the reversal conveying portion when the leading edge of the sheet contacts a second pair of rollers.
Figure 12:
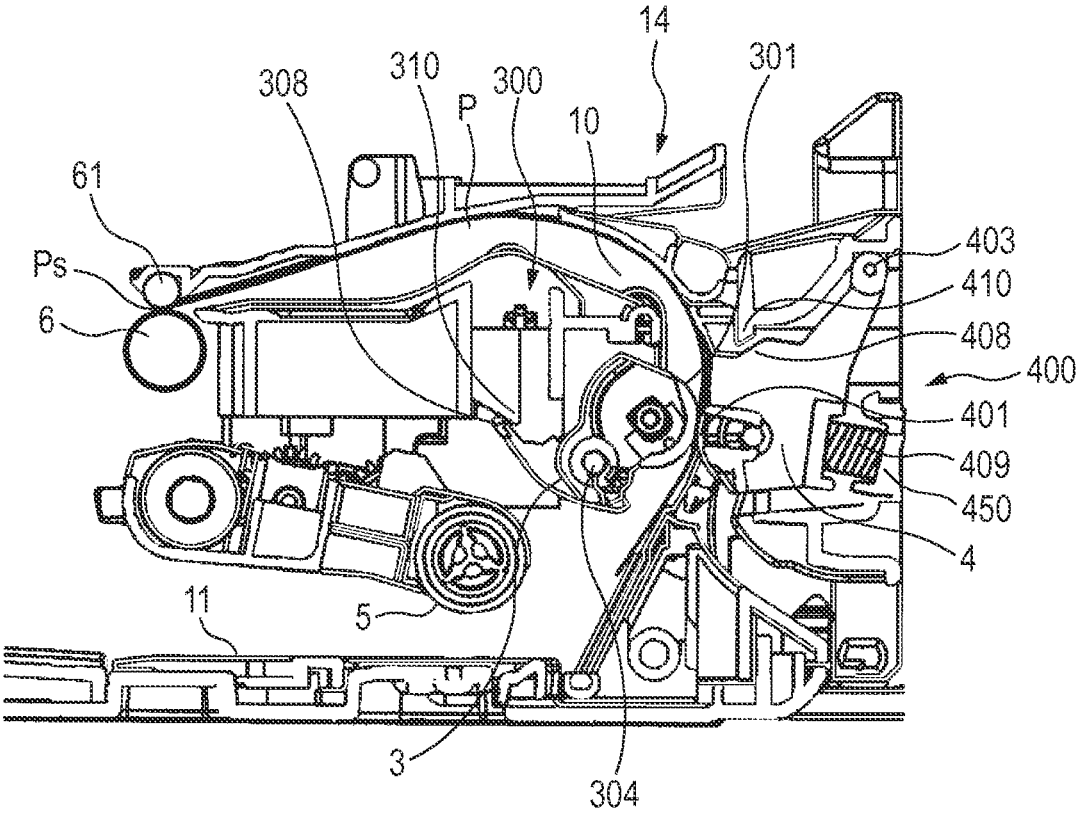
FIG. 12 is a schematic diagram illustrating the state of the reversal conveying portion when a drive roller and a driven roller reach the second position.

A leading edge Ps of the sheet P is brought to the position of the drive roller 301 by the sheet feeding roller 5, allowing the sheet P to be conveyed by the first pair of rollers (refer to FIG. 9). When the sheet P is ready to be conveyed by the first pair of rollers, the control portion B1 turns off the drive of the sheet feeding roller 5 mainly through the intermediary of the motor driver B4, so that the sheet feeding roller 5 moves away from the sheet P (refer to FIG. 10). Then, if the LF roller 6 is not rotating in the reverse direction, then the LF roller 6 begins to rotate in the reverse direction.

The sheet P is conveyed toward the second pair of rollers for predetermined time (S2), but if it is not detected by a sensor B14 that the sheet P has not reached the second pair of rollers within the predetermined time (S3), then a sheet feeding error is indicated (S11), and a user is prompted to perform a recovering operation. In response to a recovery action by the user (S12), the recording apparatus 1 resumes the sheet feeding operation (S1).

When the leading edge Ps of the sheet P reaches the LF roller 6 rotating in the reverse direction (refer to FIG. 11) (S4), an operation for correcting a skew is carried out (S5). More specifically, if the leading edge Ps of the sheet P is conveyed in a skewed manner, then one end in the width direction of the leading edge Ps of the sheet P abuts the second pair of rollers first. The preceding one end in the width direction of the leading edge Ps of the sheet P cannot pass the nip of the second pair of rollers and therefore remains at the same position.

However, while the one end in the width direction of the leading edge Ps of the sheet P remains at the same position, the other end in the width direction of the leading edge Ps of the sheet P is conveyed by the first pair of rollers and reaches the second pair of rollers. Since the LF roller 6 is rotating in the reverse direction, the other end in the width direction of the leading edge Ps of the sheet P also cannot pass the nip of the second pair of rollers and remains at the same position. Thus, the leading edge Ps of the sheet P is straightened, correcting the skew.

While the skew is being corrected, the leading edge Ps of the sheet P will not be conveyed beyond the second pair of rollers. However, the conveying roller 301 continues to convey the sheet P in the conveying direction, depriving the sheet P of anywhere to go, so that the sheet P sticks to the outer guide of the U-turn path 10.

In the case of a sheet P having high rigidity for high image quality, the drive roller 301 is subjected to the conveyance resistance from the leading edge Ps of the sheet P through the sheet P, causing the entire drive arm unit 3 to start swinging, as described above. This leads to the generation of the engaging force toward the driven roller 401. Then, the drive arm unit 3 and the driven arm unit 4 move from the first position to the second position (refer to FIG. 12).

At the second position, the drive arm stopper 308 on the drive arm 302 comes in contact with the abutting portion 310 in the inner guide unit 300, thus limiting the swing of the drive arm unit 3 and therefore preventing the engaging force from increasing any further. According to the prior art described above, there has been a possibility that the force of sandwiching a sheet between the pair of rollers, which are the intermediate roller and the driven roller, becomes excessively large, causing the conveyance of the sheet to be stopped before the skew of the leading edge of the sheet is corrected. On the other hand, the present invention restricts the first pair of rollers from sandwiching the sheet P therebetween excessively firm, making it possible to prevent an unexpected stop of the conveyance of the sheet P. Thus, the conveying apparatus in accordance with the present invention is capable of reliably correcting the skew of the leading edge Ps of the sheet P.

Figure 13:
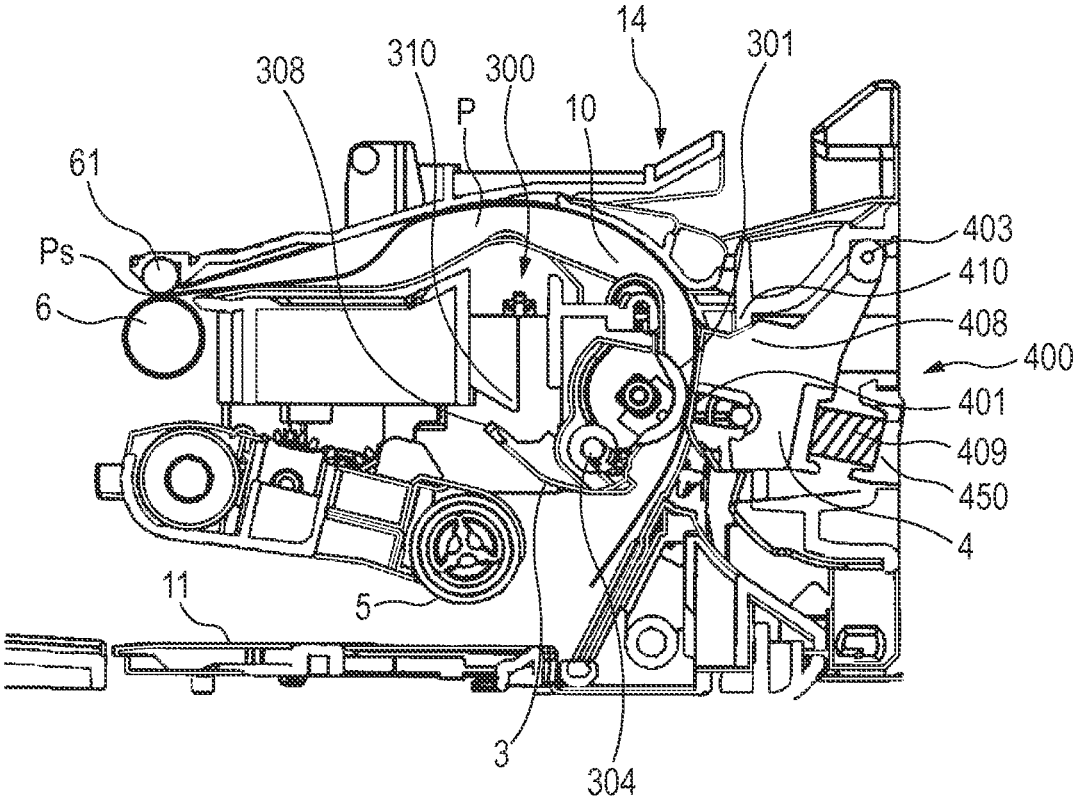
FIG. 13 is a schematic diagram illustrating the state of the reversal conveying portion when a sheet with low rigidity is continued to be conveyed from the state illustrated in FIG. 12.
Figure 14:
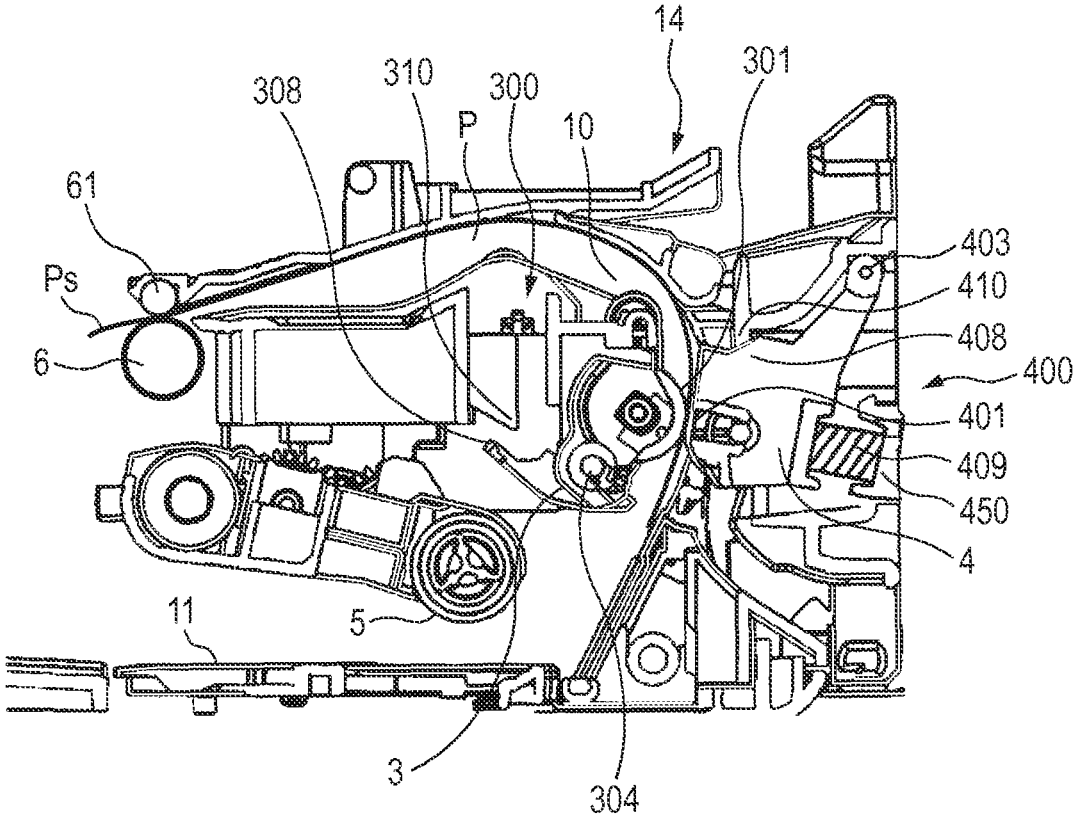
FIG. 14 is a schematic diagram illustrating the state of the reversal conveying portion when the sheet is conveyed to a horizontal conveying portion.

Meanwhile, in the case of a sheet P having low rigidity, such as plain paper, the sheet P stuck to the outer side of the internal surface of the U-turn path 10 curves, as illustrated in FIG. 13. Hence, the drive roller 301 is not subjected to the conveyance resistance from the leading edge Ps of the sheet P through the sheet P, so that the drive arm unit 3 and the driven arm unit 4 will not move to the second position and remains at the first position. Since the drive roller 301 is not subjected to the conveyance resistance, the skew of the leading edge Ps of the sheet P can be corrected.

After the correction of the skew is finished, rotating the LF roller 6 in the forward direction causes the second pair of rollers to hold the leading edge Ps of the sheet P therebetween (refer to FIG. 14), thus carrying the sheet P to a recording start position (S6).

The conveyance drive transmission system B6 is constructed such that the conveying speed of the sheet P by the LF roller 6 is higher than the conveying speed of the sheet P by the drive roller 301. Further, when the sheet P is conveyed by the second pair of rollers, the drive arm clutch mechanism 307 (refer to FIG. 5) acts such that no driving force is transmitted to the drive roller 301 and the drive roller 301 idles even in the case where the drive roller 301 is in contact with the sheet P. Since the driving force from the drive source is not transmitted to the drive arm rotating shaft 304, there will be no rotational force generated to be transmitted to the roller gear 306 from the drive gear 303. In other words, a torque based on a driving force for rotating the drive arm 302 in the direction of the arrow 322 will not be generated. Conversely, the movement of the sheet P pulled by the LF roller causes the drive roller 301 and the roller gear 306 to rotate in the direction of an arrow 321 in FIG. 6. The rotation of the roller gear 306 in the direction of the arrow 321 causes the roller gear 306 to revolve about the drive gear 303 in the direction opposite from that indicated by the arrow 322. Only the weak spring 308*a* urges the drive arm 302 in the direction of the arrow 322. The urging force imparted by the spring 308*a* is weak, so that the sandwiching force by the drive roller 301 and the driven roller 401 is weak accordingly. Thus, the drive transmission mechanism, which incorporates the drive arm clutch mechanism 307 having the drive gear 303, the roller gear 306, and the one-way clutch constitutes a sandwiching state changing unit that weakens the sandwiching force when the drive roller 301 is rotated at higher speed than that by drive.

If the sheet P is skewed, a part of the sheet P is distorted between the first pair of rollers and the second pair of rollers when the sheet P is held by the second pair of rollers. Hence, the sheet P is pulled out by the faster second pair of rollers off the nip of the first pair of rollers, which is slower than the second pair of rollers. At this time, the sheet P slips off the first pair of rollers having a weaker sandwiching force, thus removing the distortion.

Next, recording for one line is performed by the recording head unit 9 onto the sheet P that has been conveyed to the recording start position (S7). When the recording for the one line is completed, the sheet P is conveyed for one line (S8). Subsequently, it is determined whether the image formation is completed (S9), and if the image formation has not been completed, then the recording for the one line is restarted (S7). If the image formation has been completed, then the sheet P is discharged onto the sheet discharging portion 13 by the sheet discharging roller 8, thus ending the recording operation (S10).

In the above description, the skew has been corrected before the sheet P was held by the second pair of rollers. Alternatively, however, the sheet P may be temporarily held by the second pair of rollers and then the LF roller 6 may be rotated in the reverse direction so as to correct the skew of the sheet P in the same manner as that described above.

Thus, the conveying apparatus in accordance with the present invention allows the skew of the leading edge Ps of the sheet P to be corrected while conveying the sheet P by the first pair of rollers. In addition, the skew can be corrected during the normal conveying process, so that the throughput (the number of the sheets P on which images can be recorded within predetermined time) will not be lowered. Further, no large-scale mechanism or the like is required, so that the size of the conveying apparatus will not be increased or no significant increase in the cost will be involved. This makes it possible to prevent the recording apparatus 1, which has the conveying apparatus, from becoming larger, and to restrain an increase in the cost.

Second Embodiment

Figure 18:
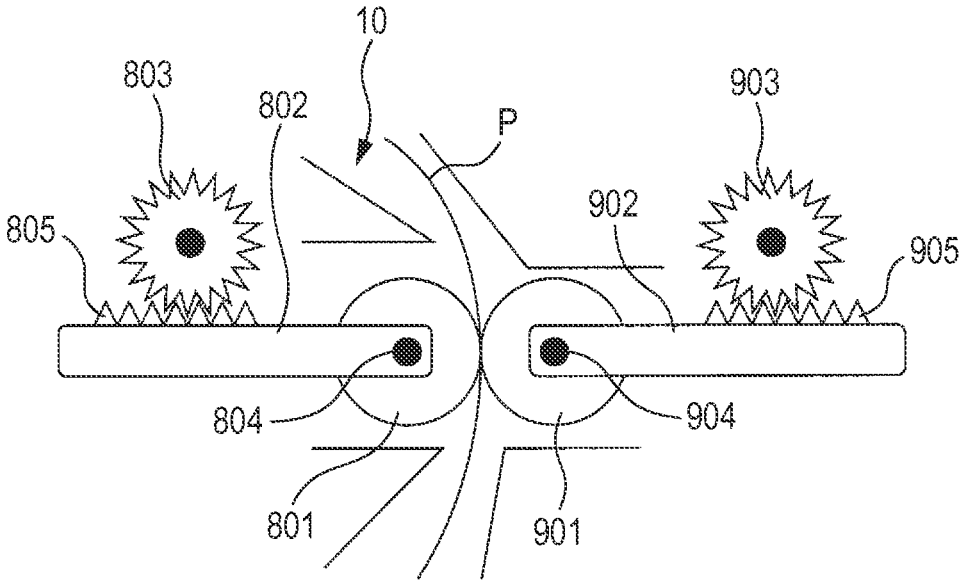
FIG. 18 is a schematic configuration diagram of an essential section of a second embodiment of the conveying apparatus in accordance with the present invention.

A second embodiment of the conveying apparatus in accordance with the present invention will be described. The description of the same components as those in the embodiment described above will be omitted. FIG. 18 is a schematic configuration diagram of an essential section of the second embodiment of the conveying apparatus in accordance with the present invention.

In the present embodiment also, a drive roller 801 and a driven roller 901 constitute a first pair of rollers. The drive roller 801 is rotatively supported by a drive arm 802 through a rotating shaft 804. Further, the drive arm 802 is provided with a rack 805, the rack 805 being engaged with a drive roller motor pinion 803 rotated by a drive roller motor (not shown). Similarly, the driven roller 901 is rotatively supported by a driven arm 902 through a rotating shaft 904. Further, the driven arm 902 is provided with a rack 905, the rack 905 being engaged with a driven roller motor pinion 903 rotated by a driven roller motor (not shown). These components, namely, the rack 805, the drive roller motor pinion 803, the drive roller motor, the rack 905, the driven roller motor pinion 903, and the driven roller motor constitute a sandwiching state changing unit.

These roller motors are controlled by a control portion B1. The drive roller 801 and the driven roller 901 can be controlled such that they linearly move between a proximal position at which the two rollers are close to each other and a spaced position at which the two rollers are away from each other. At the proximal position, a first pair of rollers holds a sheet P. Unlike the embodiment described above, the drive arm unit 3 and the driven arm unit 4 are not provided, and the drive roller 801 and the driven roller 901 are not urged.

Figure 19:
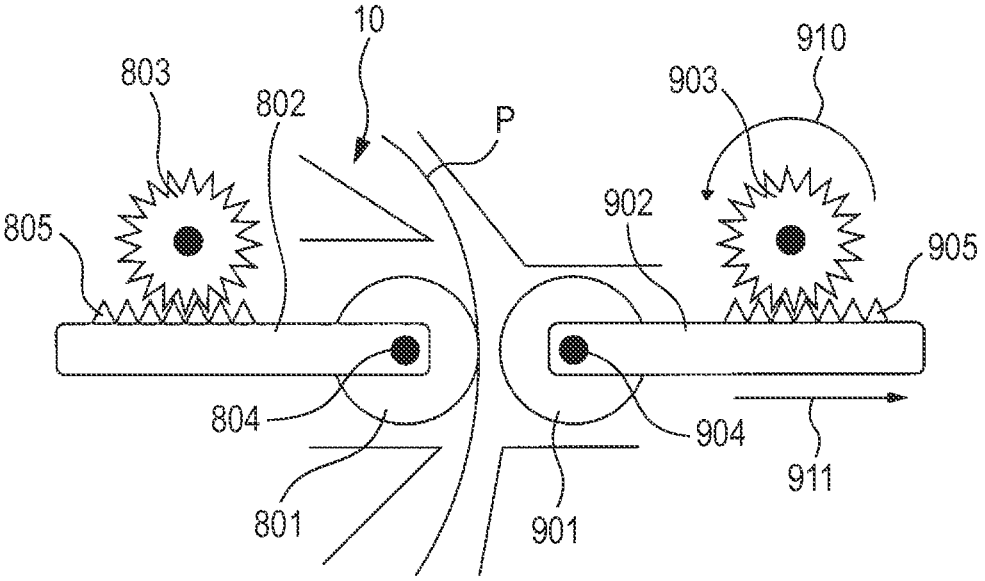
FIG. 19 is a schematic diagram of the essential section of the conveying apparatus when a driven roller has been moved to a non-contact position.
Figure 20:
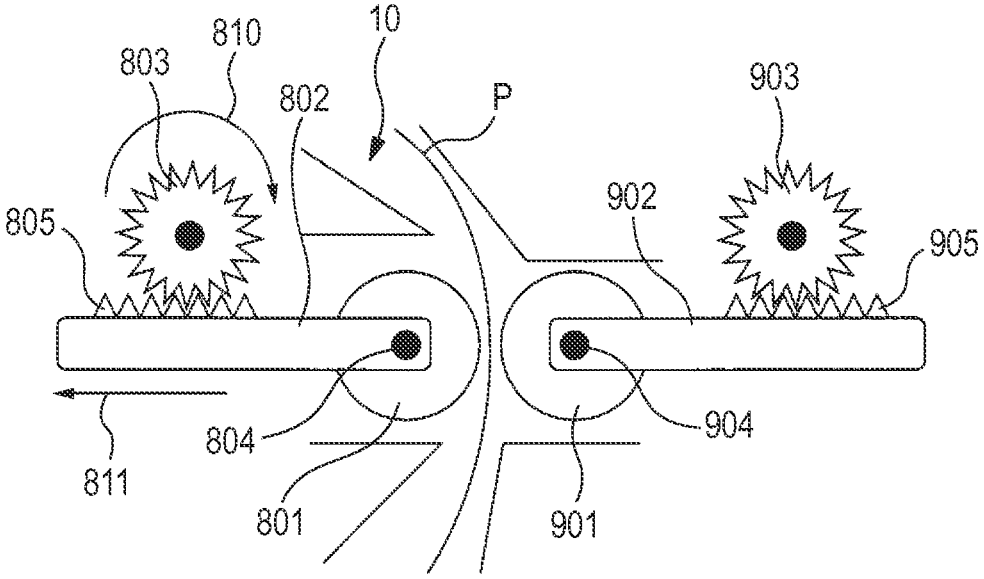
FIG. 20 is a schematic diagram of the essential section of the conveying apparatus when the driven roller and a drive roller have been moved to non-contact positions.

Referring now to FIG. 18 to FIG. 20, the states of the drive roller 801 and the driven roller 901 when the skew of the leading edge of the sheet P is corrected will be described.

When the sheet P is fed from a stacking portion 11, the sheet P is held by the first pair of rollers and conveyed (refer to FIG. 18).

If the sheet P is conveyed with a leading edge Ps thereof skewed, then one end in the width direction of the leading edge Ps of the sheet P abuts a second pair of rollers first. The preceding one end in the width direction of the leading edge Ps of the sheet P cannot pass the nip of the second pair of rollers and therefore remains at the same position, because an LF roller 6 is rotating in the reverse direction. However, while the one end in the width direction of the leading edge Ps of the sheet P remains at the same position, the other end in the width direction of the leading edge Ps of the sheet P is conveyed by the first pair of rollers and reaches the second pair of rollers. Since the LF roller 6 is rotating in the reverse direction, the other end in the width direction of the leading edge Ps of the sheet P also cannot pass the nip of the second pair of rollers and remains at the same position. Thus, the skew of the leading edge Ps of the sheet P is corrected.

If the sheet P is continued to be conveyed to correct the skew of the leading edge Ps of the sheet P, then the drive roller 801 is subjected to the conveyance resistance from the sheet P, as with the embodiment described above. When predetermined time elapses after the conveyance resistance is detected by a sensor or the like (not shown) or after one end of the leading edge Ps of the sheet P reaches the second pair of rollers, the driven roller motor pinion 903 is slightly rotated in the direction of an arrow 910 by a driven roller motor (not shown) (refer to FIG. 19). Then, the driven arm 902 is slightly moved in the direction of an arrow 911 through the intermediary of the rack 905. Thus, the driven roller 901 moves to the spaced position. This weakens the force of sandwiching the sheet P by the first pair of rollers, causing the sheet P to slightly slip off the roller pair of the drive roller 801 and the driven roller 901. Hence, a part of the sheet P stuck to the outer side of the inner surface of a U-turn path 10 comes off the outer side of the inner surface of the U-turn path 10, so that the conveyance resistance on the drive roller 801 decreases, allowing the sheet P to be conveyed. Thus, the skew of the leading edge Ps of the sheet P can be corrected.

After completing the correction of the skew, the LF roller 6 is rotated in the forward direction thereby to hold the leading edge Ps of the sheet P by the second pair of rollers and convey the sheet P to a horizontal conveying portion 16. Then, the formation of an image is begun.

When an image is formed, the transmission of a driving force to the drive roller 801 is cut off by the control portion B1, and the drive roller 801 is driven as a roller, i.e., idled, by a clutch mechanism (not shown) in order to reduce the resistance at the time of the contact with the sheet P.

At this time, a driven roller motor (not shown) is controlled to rotate the drive roller motor pinion 803 in the direction of an arrow 810, thereby moving the drive arm in the direction of an arrow 811 through the intermediary of the rack 805. In other words, it is possible to further reduce the contact between the drive roller 801 and the sheet P by moving the drive roller 801 to the spaced position (refer to FIG. 20).

At this time, the sheet P sandwiched by the first pair of rollers is completely released, thus eliminating the distortion of the sheet P caused by the first pair of rollers.

Alternatively, at the time of forming an image, instead of stopping the transmission of a driving force to the drive roller 801, the drive roller 801 may be rotated as fast as the LF roller 6 or faster than the LF roller 6 in the state wherein the sheet P has been released from the first pair of rollers. This makes it possible to further reduce the resistance generated when the drive roller 801 and the sheet P come into contact with each other.

Third Embodiment

A third embodiment of the conveying apparatus in accordance with the present invention will be described. The present embodiment has a construction based on the construction of the second embodiment. More specifically, the present embodiment uses sensors, such as a sheet type discriminating sensor adapted to discriminate the type of a sheet P by detecting the glossiness of the sheet P, a plurality of sheet size discriminating sensors (not shown) disposed on a stacking portion 11, a temperature sensor, and a humidity sensor.

For example, if the sheet type discriminating sensor detects that the sheet P is a high image quality sheet with high rigidity, then the driven roller 901 is moved to a spaced position when a skew is corrected (refer to FIG. 19). Meanwhile, if the sheet type discriminating sensor detects that the sheet P is a low-rigidity sheet P, such as plain paper, then the driven roller 901 remains at the proximal position (refer to FIG. 18). In the case of the low-rigidity sheet, the conveyance resistance is low, so that keeping the driven roller 901 at the proximal position permits a higher capability of correcting a skew and a higher throughput.

Further, the spaced position of the driven roller 901 may be changed according to the size of the sheet P detected by the sheet size discriminating sensors. For example, in the case of a small-size sheet, such as an L-size sheet, a small diameter of a U-turn path 10 makes it difficult for the sheet P to curve along the shape of the U-turn path 10. Hence, the sheet P conveyed by a first pair of rollers fails to curve along the shape of the U-turn path 10. As a result, the leading edge of the sheet P moves toward an LF roller 6, whereas the trailing edge thereof attempts to move toward the driven roller 901 so as to move as straight as possible. For this reason, positioning the driven roller 901 more farther from a drive roller 801 than in the case of a larger-sized sheet P makes it possible to reduce the possibility of the driven roller 901 coming in contact with the sheet P, thus permitting further reduced a distortion of the sheet P after correcting a skew.

Further, in an atmosphere of a high temperature and a high humidity, the rigidity of even a high image quality sheet with high rigidity reduces. Therefore, if the temperature sensor and/or the humidity sensor detects a high temperature and/or a high humidity in the conveying apparatus, then the sheet P easily curves when a leading edge Ps of the sheet P is abutted against the LF roller 6 to correct a skew, thus deteriorating the capability of correcting the skew.

To prevent the aforesaid problem, the spaced position of the driven roller 901 is preferably shifted toward the drive roller 801 when correcting the skew of the sheet P. This increases the conveying force of the sheet P at the time of correcting the skew.

A conveying apparatus with still higher reliability can be provided by making fine adjustment of the positions of the drive roller 801 and the driven roller 901 as necessary on the basis of the detection results of the aforesaid sensors.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-179476, filed Aug. 19, 2011, which is hereby incorporated by reference herein in its entirety.

What is claimed is:

1. A conveying apparatus comprising:

a first pair of rollers which has a drive roller and a pinch roller, and conveys a sheet in a conveying direction;

an arm which supports the drive roller and which swings coaxially with a rotating shaft rotated by drive from a drive source;

a second pair of rollers which is positioned downstream of the first pair of rollers in the conveying direction and which conveys the sheet conveyed by the first pair of rollers; and a mechanism which is adapted to reduce a force for sandwiching the sheet by the first pair of rollers, wherein the mechanism includes a transmitting unit which transmits the rotation of the rotating shaft to the drive roller so as to rotate the drive roller such that the sheet is conveyed in the conveying direction in the case where the rotating shaft rotates in the same direction as the swing direction of the arm at the time the arm swings to press the drive roller against the pinch roller, and a clutch that cuts off a rotational force transmitted from the drive source to the rotating shaft, and wherein after a leading edge of the sheet conveyed by the first pair of rollers is stopped by the second pair of rollers, the second pair of rollers starts conveying the sheet, and the mechanism works while the sheet is conveyed by the second pair of rollers.

2. A recording apparatus comprising the conveying apparatus according to claim 1 and a recording portion which performs recording on a sheet that is conveyed.

3. The conveying apparatus according to claim 1, wherein the transmitting unit has a gear train and the clutch is a one-way clutch which turns off the transmission of drive in the case where the rotating shaft is rotated faster than a rotating member on a drive side.

4. The conveying apparatus according to claim 3, wherein the conveying speed of the sheet by the second pair of rollers is higher than the conveying speed of the sheet by the first pair of rollers.

5. A conveying apparatus comprising:

a first pair of rollers which has a drive roller and a pinch roller, and conveys a sheet in a conveying direction;

an arm member rotatable supporting the drive roller, the arm member being swingable;

a second pair of rollers which is positioned downstream relative to the first pair of rollers in the conveying direction and which conveys the sheet conveyed by the first pair of rollers;

a limiting member for limiting swing of the arm member; and a mechanism which separates the drive roller and the pinch roller, wherein the mechanism includes a transmitting unit which transmits the rotation of the rotating shaft to the drive roller so as to rotate the drive roller such that the sheet is conveyed in the conveying direction in the case where the rotating shaft rotates in the same direction as the swing direction of the arm at the time the arm swings to press the drive roller against the pinch roller, and a clutch that cuts off a rotational force transmitted from a drive source to the rotating shaft, and wherein when the leading edge of the sheet conveyed by the first pair of rollers is stopped by the second pair of rollers, the arm member swinging to move the drive roller to a direction of the pinch roller and the arm member being limited by the limiting member if the arm member swings not less than a predetermined amount.

6. The conveying apparatus according to claim 5, wherein the transmitting unit has a gear train and the clutch is a one-way clutch which turns off the transmission of drive in the case where the rotating shaft is rotated faster than a rotating member on a drive side.

7. The conveying apparatus according to claim 6, wherein the conveying speed of the sheet by the second pair of rollers is higher than the conveying speed of the sheet by the first pair of rollers.

8. A recording apparatus comprising the conveying apparatus according to claim 5 and a recording portion which performs recording on a sheet that is conveyed.

9. A conveying apparatus comprising:

a U-turn path defined by an inner guide unit which forms an inner boundary of the U-turn path and a rear guide unit which forms an outer boundary of the U-turn path;

a first pair of rollers provided to convey a sheet in a conveying direction, the first pair of rollers including a drive roller provided inside of the U-turn path and driven by a motor and a pinch roller provided at the outer boundary of the U-turn path and rotating with the drive roller;

a drive arm unit rotatably supporting the drive roller, the drive arm unit being swingable about an axis;

a second pair of rollers which is positioned downstream relative to the first pair of rollers in the conveying direction and which conveys the sheet conveyed by the first pair of rollers; and a limiting member for limiting the movement of the drive arm unit, wherein said conveying apparatus is configured so that when the leading edge of the sheet conveyed by the first pair of rollers is stopped by the second pair of rollers, the drive arm unit, by a conveyance resistance subjected to the drive roller from the sheet, is caused to rotate so as to move a center drive axis of the drive roller in a direction of the pinch roller until the drive arm unit is limited by the limiting member after the drive arm unit moves at least a predetermined amount.

10. The conveying apparatus according to claim 9, wherein a conveying speed of the sheet by the second pair of rollers is higher than a conveying speed of the sheet by the first pair of rollers.

11. A recording apparatus comprising the conveying apparatus according to claim 9 and a recording portion which performs recording on a sheet that is conveyed.

12. The conveying apparatus according to claim 9, wherein the rear guide unit comprises a second arm unit rotatably supporting the pinch roller, the second arm unit moving to follow the drive roller.

13. The conveying apparatus according to claim 9, further comprising an urging unit for urging the pinch roller toward the drive roller.

14. The conveying apparatus according to claim 9, wherein when the sheet is conveyed by the second pair of rollers, the drive roller idles.

15. The conveying apparatus according to claim 9, wherein the second pair of rollers is driven by a drive force of the motor.

16. The conveying apparatus according to claim 9, wherein after the sheet is conveyed with a predetermined amount in a conveying direction by the second pair of rollers, the second pair of rollers is rotated in a direction opposite to the conveying direction to correct the skew of the sheet.

17. The conveying apparatus according to claim 9, wherein the leading edge of the sheet conveyed by the first pair of rollers is in contact with the second pair of rollers to correct the skew of the sheet.

18. The conveying apparatus according to claim 9, wherein the leading edge of the sheet conveyed by the first pair of rollers is in contact with the second pair of rollers rotating in a direction opposite to the conveying direction to correct the skew of the sheet.

* * * * *